US009968194B2

(12) United States Patent
Bushey

(10) Patent No.: US 9,968,194 B2
(45) Date of Patent: May 15, 2018

(54) FURNITURE GLIDE WITH RIGID ARCING SIDEWALL

(71) Applicant: Expanded Technologies Corp., Kenosha, WI (US)

(72) Inventor: Dennis J. Bushey, East Troy, WI (US)

(73) Assignee: Expanded Technologies Corp., Kenosha, WI (US)

( * ) Notice: Subject to any disclaimer, the term of this patent is extended or adjusted under 35 U.S.C. 154(b) by 0 days. days.

(21) Appl. No.: 14/757,867

(22) Filed: Dec. 23, 2015

(65) Prior Publication Data

US 2016/0174708 A1 Jun. 23, 2016

Related U.S. Application Data

(60) Provisional application No. 62/096,058, filed on Dec. 23, 2014.

(51) Int. Cl.
*A47B 91/06* (2006.01)

(52) U.S. Cl.
CPC ..... *A47B 91/06* (2013.01)

(58) Field of Classification Search
CPC ..... A47B 91/06
See application file for complete search history.

(56) References Cited

U.S. PATENT DOCUMENTS 1,903,609 A * 4/1933 Uhl ..... A47B 91/04 16/42 R
1,915,272 A * 6/1933 Duncan, Jr. ..... A47B 91/04 248/188.9
2,699,628 A 1/1955 Auer
2,787,085 A 4/1957 Auer
2,865,133 A * 12/1958 Hoven ..... A47B 13/06 16/30
2,899,703 A 8/1959 Johnson
3,050,770 A 8/1962 Morse et al.
3,362,040 A 1/1968 Gurzenda
3,484,891 A 12/1969 Borgen
3,741,226 A * 6/1973 Urban ..... A61H 3/0288 135/84
3,969,786 A 7/1976 Peak
3,994,043 A 11/1976 Gurzenda
4,355,777 A * 10/1982 Greenstreet ..... A47B 91/04 248/188.9
5,081,740 A * 1/1992 Smith ..... A47B 91/06 16/42 R
5,220,705 A 6/1993 Bushey
5,426,818 A 6/1995 Bushey
D368,022 S 3/1996 Angle
5,557,824 A 9/1996 Bushey
(Continued)

*Primary Examiner* — Jeffrey O'Brien
(74) *Attorney, Agent, or Firm* — Boyle Fredrickson, S.C.

(57) ABSTRACT

A furniture glide is provided as a snap on cap that is mountable on the terminal end of a furniture leg having an outer surface. The furniture glide includes an interior volume having an outer surface and an inner surface defining a cavity for receiving the furniture leg. A sidewall of the cavity may be arced so as to precisely conform to a furniture leg. Matted material is molded into the outer surface of the cup. As a result, the furniture glide may fit snugly and securely without shearing off, though it may still be removable, and the furniture glide may avoid the requirement of adhesives, though adhesives could optionally be used.

19 Claims, 3 Drawing Sheets

(56) References Cited

U.S. PATENT DOCUMENTS 5,581,944 A 12/1996 Raheb et al.
5,603,141 A 2/1997 Gledill
5,689,853 A 11/1997 Lemmer
5,945,178 A * 8/1999 Volkmann ..... A47B 91/00 248/188
6,295,697 B1 10/2001 Simon
6,324,725 B1 * 12/2001 Green ..... A47B 91/06 16/42 R
6,405,982 B2 * 6/2002 Ferencz ..... A47B 91/06 16/42 R
D482,264 S * 11/2003 Shiffler ..... D8/374
D513,169 S 12/2005 Bushey
7,234,199 B2 * 6/2007 Bushey ..... A47B 91/06 16/42 R
7,234,200 B2 * 6/2007 Chase ..... A47B 91/06 16/42 R
7,237,302 B2 * 7/2007 Bushey ..... A47C 5/08 16/32
7,404,232 B2 * 7/2008 Chase ..... A47B 91/06 16/42 R
7,533,858 B2 * 5/2009 Straus ..... A47B 91/06 248/188.2
D617,631 S * 6/2010 Bushey ..... D8/374
7,757,346 B2 * 7/2010 Chase ..... A47B 91/06 16/42 R
8,028,374 B2 * 10/2011 Lang ..... A47B 91/06 16/42 R
8,037,574 B2 * 10/2011 Chase ..... A47B 91/06 16/42 R
8,438,701 B2 * 5/2013 Bushey ..... A47B 91/06 16/42 R
8,607,413 B2 * 12/2013 Carpinella ..... A47B 91/066 16/42 R
8,998,164 B2 * 4/2015 Marquardt ..... F16M 11/36 248/188.9
9,027,891 B2 * 5/2015 Desmarais ..... B60B 33/0028 248/188.9
2003/0163894 A1 9/2003 Jones et al.
2005/0034268 A1 2/2005 Wurdack
2005/0081330 A1 * 4/2005 Edwards ..... A47B 91/06 16/42 R
2005/0115022 A1 * 6/2005 Desmarais ..... A47B 91/066 16/42 R
2008/0042025 A1 2/2008 Brouard et al.
2008/0258023 A1 * 10/2008 Desmarais ..... A47B 91/12 248/188.9
2010/0018005 A1 * 1/2010 Bushey ..... A47B 91/06 16/42 T
2012/0167346 A1 * 7/2012 Bushey ..... A47B 91/06 16/42 T

* cited by examiner

FURNITURE GLIDE WITH RIGID ARCING SIDEWALL

CROSS-REFERENCE TO RELATED APPLICATION

This application claims priority from U.S. Provisional Patent Application Ser. No. 62/096,058 filed on Dec. 23, 2014, the entirety of which is expressly incorporated by reference herein.

FIELD OF THE INVENTION

A furniture glide is provided that is mountable on the terminal end of a furniture leg having an outer surface. The furniture glide includes an interior volume having an outer surface and an inner surface defining a cavity for receiving the furniture leg.

BACKGROUND OF THE INVENTION

Coasters are often used under the legs of a piece of furniture to act as a buffer between the legs and the floor on which the piece of furniture rests. Typically, coasters take the form of glass or rubber discs having flat bottoms that rest on the floor. By positioning the coasters between the furniture legs and the floor, the weight of the furniture leg is dispersed over a larger area such that the furniture leg does not scratch or mar the floor when the piece of furniture is moved or leave a depression in the floor when the piece of furniture remains in one place for an extended period of time.

In addition, furniture glides or sliders have been developed that are also positioned between the legs of a piece of furniture and the carpeting on which the piece of furniture rests. By way of example, Bushey, U.S. Pat. No. 5,220,705, discloses a furniture glide that facilitates the movement of a piece of furniture on carpeted and bare floors. The furniture glide includes a convo-convex disc having an arcuate convex lower surface, a concave upper surface defining a central cavity, and resilient pad fixed to the disc upper surface within the central cavity below the edge thereof. Adhesive is provided for securing the resilient pad to the bottom of the piece of furniture or to the leg of the piece of furniture.

While functional for its intended purpose, the furniture glide disclosed in the Bushey '705 patent has certain limitations. More specifically, repeated movement of a piece of furniture along a floor may cause the adhesive to fail such that the resilient pad becomes detached from the bottom of the piece of furniture. As a result, the furniture glide may become separated from the piece of furniture such that the bottom of piece of furniture may engage and damage the flooring. Therefore, it is highly desirable to provide a furniture glide and/or coaster that may be simply secured to a bottom of a piece of furniture to prevent damage to the flooring on which the piece of furniture rests.

Alternatively, Bushey, U.S. Pat. No. 7,234,199 discloses a furniture glide for mounting on the terminal end of a furniture leg having an outer surface. The furniture glide includes a base having a generally arcuate lower surface for engaging a supporting surface. A sleeve extends from the base and defines a cavity for receiving the furniture leg therein. The sleeve includes a leg engagement element for engaging the furniture leg received within the cavity and for allowing the furniture leg to be supported within the cavity at an angle thereto. However, the addition of the sleeve to the furniture glide substantially increases the overall cost of such glide.

Therefore, what is needed is an improved furniture glide which can fit snuggly and securely to a terminal end of a furniture leg without one or more of the aforementioned drawbacks.

SUMMARY OF THE INVENTION

In accordance with the present invention, a furniture glide is provided as a snap on cap that is mountable on the terminal end of a furniture leg having an outer surface. The furniture glide includes an interior volume having an outer surface and an inner surface defining a cavity for receiving the furniture leg. A rigid sidewall of the cavity may be arced so as to precisely conform to a furniture leg. Matted material is molded into the outer surface of the cup. As a result, the furniture glide may fit snugly and securely without shearing off, though it may still be removable, and the furniture glide may avoid the requirement of adhesives, though adhesives could optionally be used.

In accordance with an aspect of the present invention, a furniture glide may be mountable on a terminal end of a furniture leg having an outer surface. The furniture glide may include a base having an upper surface, a lower surface and an outer periphery. The furniture glide may also include a sidewall arcing upwardly and outwardly from the outer periphery of the base and then inwardly to form an upper lip. The sidewall may have an inner surface defining a cavity for receiving the furniture leg and an outer surface. A matted material may be molded into the lower surface of the base and the outer surface of the sidewall.

It is contemplated for the inner surface of the sidewall to form a generally concave edge around the base. The sidewall may be fabricated from a rigid plastic material, and the matted material may be fabricated from a felt fabric.

In accordance with a further aspect of the present invention, a furniture glide is provided which is mountable on a terminal end of a furniture leg having an outer surface. The furniture glide includes a base having an upper surface, a lower surface and an outer periphery. A sidewall extends upwardly from the outer periphery of the base. The sidewall has an inner surface defining a cavity for receiving the terminal end of the furniture leg, an outer surface, a lower portion adjacent the outer periphery of the base, an upper portion and intermediate portion therebetween. A matted material is molded into the lower surface of the base and the outer surface of the sidewall. The intermediate portion of the sidewall has a thickness less than a thickness of the upper portion of the sidewall and less than a thickness of the lower portion.

The sidewall may be fabricated from a rigid plastic material and the matted material may be fabricated from a felt fabric. A base indentation area is approximately centered with respect to the base. The base indentation area is substantially thinner than another area of the base. The matted material includes an outer surface. The outer surface of the matted material includes an indentation centered with respect to the base in which the matted material is molded. The upper surface of the base also includes an indentation. The indentation in the upper surface of the base is axially aligned with the indentation in the outer surface of the matted material.

In accordance with a still further aspect of the present invention, a furniture glide is provided which is mountable on a terminal end of a furniture leg having an outer surface.

The furniture leg includes a base having an upper surface, a lower surface and an outer periphery. The upper surface includes an indentation centrally disposed therein. A sidewall extends upwardly from the outer periphery of the base. The sidewall has an inner surface defining a cavity for receiving the terminal end of the furniture leg and an outer surface. A matted material has an inner surface molded into the lower surface of the base and the outer surface of the sidewall and an outer surface. The outer surface of the matted material includes an indentation axially aligned with the indentation in the upper surface of the base.

The sidewall includes a lower portion adjacent the outer periphery of the base, an upper portion and intermediate portion therebetween. The intermediate portion of the sidewall has a thickness less than a thickness of the upper portion of the sidewall and less than a thickness of the lower portion. The sidewall may be fabricated from a rigid plastic material and the matted material may be fabricated from a felt fabric. It is contemplated for the inner surface of the sidewall to be generally concave.

Other aspects, objects, features, and advantages of the invention will become apparent to those skilled in the art from the following detailed description and accompanying drawings. It should be understood, however, that the detailed description and specific examples, while indicating preferred embodiments of the present invention, are given by way of illustration and not of limitation. Many changes and modifications may be made within the scope of the present invention without departing from the spirit thereof, and the invention includes all such modifications.

BRIEF DESCRIPTION OF THE DRAWINGS

Preferred exemplary embodiments of the invention are illustrated in the accompanying drawings in which like reference numerals represent like parts throughout.

DETAILED DESCRIPTION OF THE DRAWINGS

Figure 1:
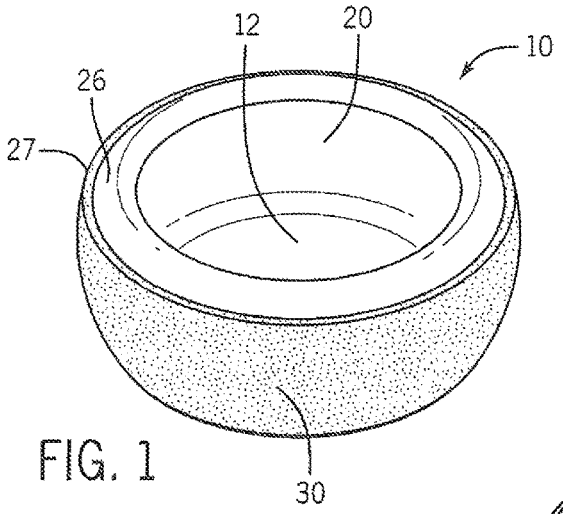
FIG. 1 is an isometric view of a furniture glide in accordance with the present invention.
Figure 2:
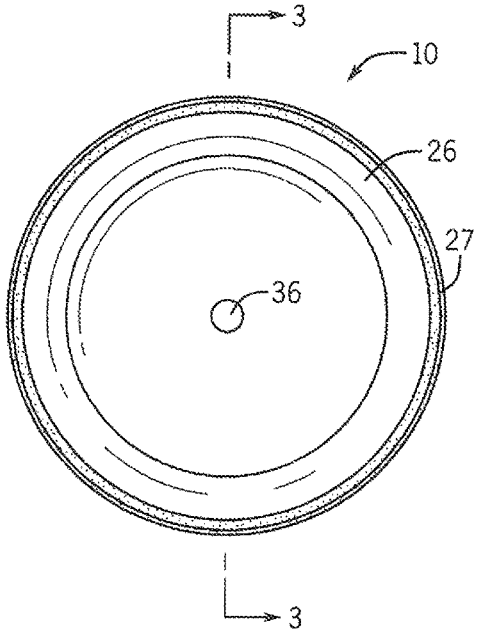
FIG. 2 is a top plan view of the furniture glide of FIG. 1.
Figure 3:
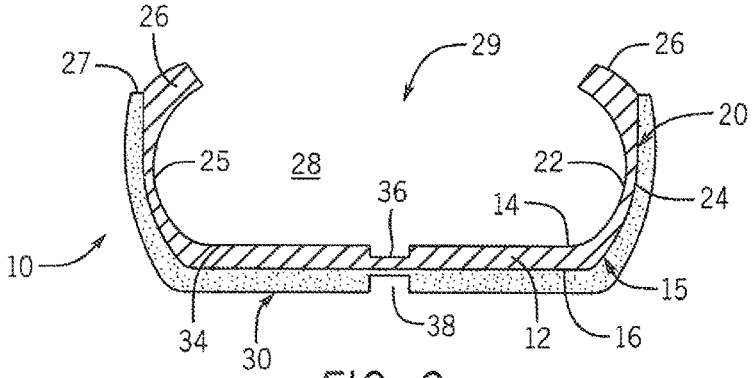
FIG. 3 is a cross-sectional view of the furniture glide of the present invention taken along line 3-3 of FIG. 2.

Referring to FIGS. 1-3, a furniture glide in accordance with the present invention is generally designated by the reference numeral 10. Furniture glide 10 includes a base 12 having a generally flat upper surface 14, a generally flat bottom surface 16 and an outer periphery 15. A sidewall 20 arcs upwardly and outwardly from the outer periphery 15 of the base 12 at a location adjacent the outer periphery 15 of the base 12. The sidewall 20 then arcs back inwardly to form an upper lip 26. The upper lip 26 of the sidewall 20, in turn, defines an opening 29, which may have a circumference greater than the outer periphery 15. As a result, the inner surface 22 of the sidewall 20 forms a rounded, generally concave edge around the base 12 with an interior cavity 28. The cavity 28 is bounded by the upper surface 14 of the base 12 at a lower end, and the upper lip 26 at an upper end.

At an approximate circumferential midpoint 25 between the outer periphery 15 of the base 12 and the upper lip 26, the sidewall 20 may be generally perpendicular with respect to the base 12. In addition, the sidewall 20 may be may be thinner at the midpoint 25 than other areas of the sidewall 20.

It is contemplated for the sidewall 20 to be fabricated from a rigid plastic material such as polypropylene, polyethylene, nylon or ABS. While the furniture glide 10 has a generally circular configuration, other configurations, such as squares, ovals or the like, are possible without deviating from the scope of the present invention.

The furniture glide 10 may be provided in variety of configurations with differing dimensions, such as with respect to heights of the sidewall 20, circumferences of the outer periphery 15 and/or the upper lip 26, and volumes of the cavity 28 (such as standard and deep). Such dimensions may be configured to accommodate a tighter fit with various terminal ends of furniture legs such that the furniture glide 10 will not fall off, but still be removable, and such that the furniture glide 10 will not require adhesives, though optional adhesives (such as an adhesive pad adhered to the upper surface 14 of the base 12) could still be used. Accordingly, due to the shape of the cavity sidewall 20, a terminal end of a furniture leg may fit snugly and securely to the furniture glide 10 to extend the life of the chair, reduce noise and/or protect the floor.

As best seen in FIGS. 1 and 3, it is contemplated to cover the bottom surface 16 of the base 12 and the outer surface 24 of the sidewall 20 with matted material 30 such as felt fabric. The matted material 30 could be fabricated, for example, from polyester, Polypropylene, polyethylene, acrylic or nylon fibers. Preferably, the matted material 30 may be molded, imbedded or fused into the bottom surface 16 of the base 12 and the outer surface 24 of the sidewall 20 of the furniture glide 10.

A mating layer 27 may be formed between the upper lip 26 and the matted material 30. The mating layer 27 may provide adherence between the upper lip 26 and the matted material 30.

As best seen in FIGS. 2 and 3, the base 12 may also include a base indentation area 36 that is approximately centered with respect to the base 12. The base indentation area 36 may be an area of the base 12 that indents from the upper surface 14 of the base 12 to the bottom surface 16 of the base 12. The base indentation area 36 may be substantially thinner than others areas of the base 12, or alternatively, the base indentation area 36 could be a hole in the base 12.

The base indentation area 36 may also be disposed over, and in communication with, a matted indentation area 38 that is approximately centered with respect to a bottom of the matted material 30. The matted indentation area 38 may be an area of the matted material 30 that indents toward the bottom surface 16 of the base 12 and, in turn, the base indentation area 36. Accordingly, the base indentation area 36 and the matted indentation area 38 meet at a centered area of base 12 of the furniture glide 10. The base indentation area 36 and the matted indentation area 38 may be advantageously used for centering a terminal end of a furniture leg, evening weight distribution of the furniture glide 10 with respect to the floor, and/or accommodating a manufacturing process for forming the furniture glide 10.

Figure 4:
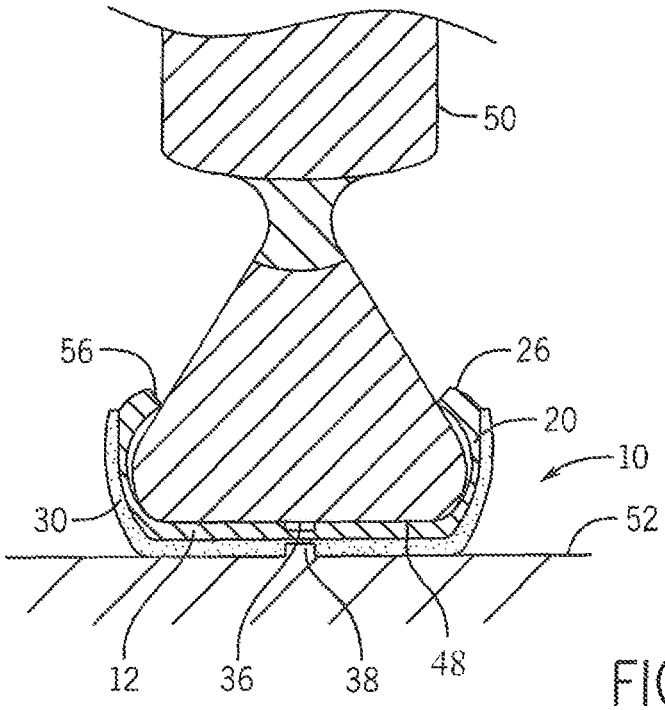
FIG. 4 is a side elevational view showing the furniture glide of FIG. 1 mounted on a chair glide of a piece of furniture.

Referring now to FIG. 4, in one aspect of operation, a furniture glide 10 may be mounted on a terminal end 48 of a piece of furniture (not shown). The terminal end 48 may be generally flat on the bottom and generally convex on the sides so as to snugly fit with respect to the upper surface 14 of the base 12 and the sidewall 20 in the cavity 28. The terminal end 48 of furniture leg 50 may be inserted through the opening 29 into the cavity 28 of the furniture glide 10. As the furniture leg 50 is inserted into the cavity 28 in the furniture glide 10, the terminal end 48 of the furniture leg 50 may center with respect to the base indentation area 36.

Due to the generally convex sides of the terminal end 48, the terminal end 48 may occupy approximately a full volume of the cavity 28 when the furniture glide 10 is installed, thereby leaving only a nominal gap between the terminal end 48 and the sidewall 20 when installed. The upper lip 26 may rigidly hold the terminal end 48 (which terminal end narrows as it extends upward from its bottom) at a contact circumference 56. Once the furniture glide 10 has been secured to the terminal end 48 of the furniture leg 50, the piece of furniture may also be positioned such that the matted material 30 along the bottom surface 16 of the furniture glide 10 engages a supporting surface 52 which may be the floor. Thereafter, the piece of furniture may be slid along the supporting surface 52 via the furniture glide 10.

It can be appreciated that as the piece of furniture is slid along supporting surface 52, the sidewall 20 acts to discourage furniture glide 10 from shearing off the terminal end 48 of furniture leg 50.

Figure 5:
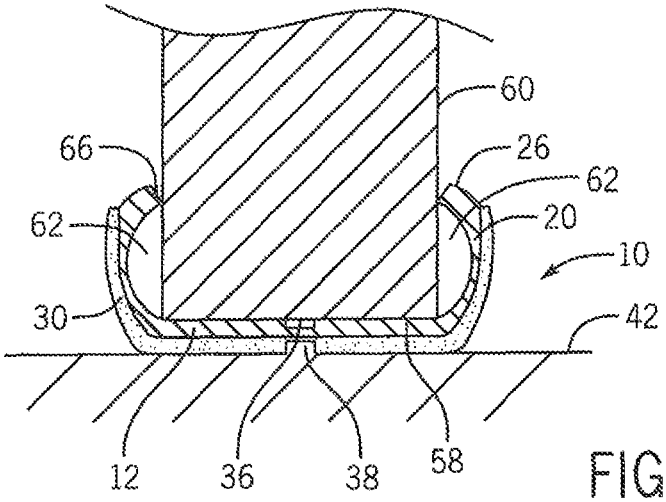
FIG. 5 is a side elevational view showing the furniture glide of FIG. 1 mounted on a foot of a piece of furniture.

Referring now to FIG. 5, in another aspect of operation, a furniture glide 10 may be mounted on a terminal end 58 of a furniture leg 60. The terminal end 58 may be a generally straight furniture leg, or other shape not precisely conforming to the cavity 28, of a piece of furniture (not shown). The terminal end 58 of furniture leg 60 may be inserted through opening 29 into the cavity 28 of the furniture glide 10. As the furniture leg 60 is inserted into the cavity 28 in the furniture glide 10, the terminal end 58 of furniture leg 60 may center with respect to the base indentation area 36.

Due to the generally straight leg of the furniture leg 60 (or other shape not precisely conforming to the cavity 28), a gap 62 may be formed between the furniture leg 60 and the inner surface 22 of the sidewall 20. However, the upper lip 26 may rigidly hold the furniture leg 60 at a contact circumference 66. Once the furniture glide 10 has been secured to the terminal end 58 of the furniture leg 60, the piece of furniture may also be positioned such that the matted material 30 along the bottom surface 16 of the furniture glide 10 engages the supporting surface 52. Thereafter, the piece of furniture may be slid along the supporting surface 52 via the furniture glide 10.

Figure 6:
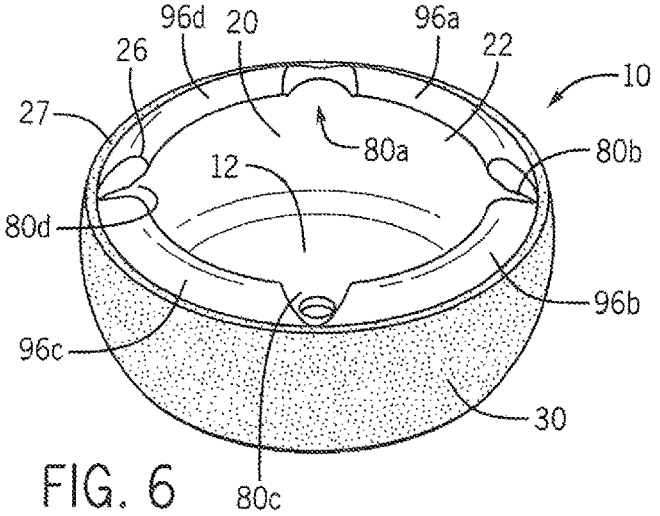
FIG. 6 is an isometric view of an alternate version of the furniture glide of FIG. 1.
Figure 7:
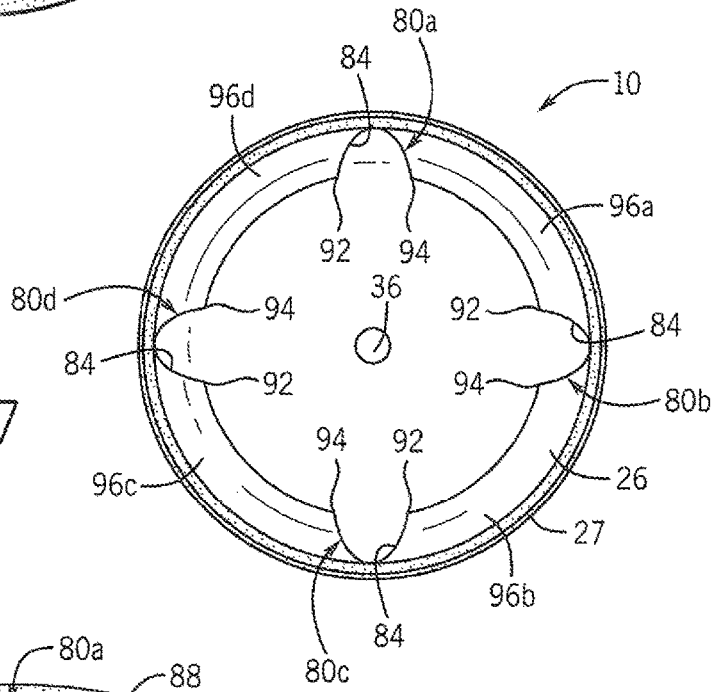
FIG. 7 is a top plan view of the furniture glide of FIG. 6.
Figure 8:
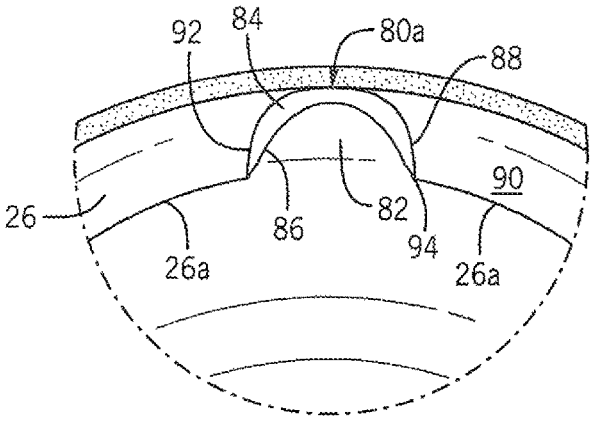
FIG. 8 is an enlarged view showing a notch in a lip of the furniture glide of FIG. 6.

Referring to FIGS. 6-7, an alternate version of furniture glide 10 is depicted. It is contemplated for furniture glide 10 to include a plurality of circumferentially spaced notches 80*a*-80*d* in upper lip 26 of the sidewall 20. Each notch 80*a*-80*c* is identical in structure. As such, the description of notch 80*a* hereinafter provided is intended to describe notches 80*b*-80*d*, as if fully described herein. It is also noted that while furniture glide 10 is depicted as having four circumferentially spaced notches 80*a*-80*d* in upper lip 26 of the sidewall 20, the number of notches in upper lip 26 of the sidewall 20 may vary without deviating from the scope of the present invention.

Notch 80*a* is formed by providing a recess 82 in radially inner edge 26*a* of lip 26. More specifically, notch 80*a* is defined by concave wall 84 formed in lip 26. Concave wall 84 includes a lower edge 86 which intersects inner surface 22 of sidewall 20 and an upper edge 88 which intersects upper surface 90 of lip 26. A first end of concave wall 84 intersects inner edge 26*a* of lip 26 at first terminal edge 92 and a second end of concave wall 84 intersects inner edge 26*a* of lip 26 at second terminal edge 94, which is circumferentially spaced from first terminal edge 92.

Notches 80*a*-80*d*, circumferentially spaced about lip 26, divide lip 26 into corresponding circumferentially spaced lip portions 96*a*-96*d*. It can be appreciated that notches 80*a*-80*d* in lip 26 increases the flexibility of circumferentially spaced lip portions 96*a*-96*d*, and hence, lip 26. As a result, as terminal end 48 of furniture leg 50 is inserted through the opening 29 into the cavity 28 of the furniture glide 10, the circumferentially spaced lip portions 96*a*-96*d* may be flexed outwardly so as to facilitate insertion of terminal end 48 of furniture leg 50 through opening 29 and into the cavity 28. When received in cavity 28 of the furniture glide 10, terminal end 48 of the furniture leg 50 is centered with respect to the base indentation area 36, as heretofore described. In addition, inner edge 26*a* of lip portions 96*a*-96*d* of lip 26 rigidly holds terminal end 48 at contact circumference 56. It can be further appreciated that as a piece of furniture is slid along supporting surface 52, sidewall 20 acts to discourage furniture glide 10 from shearing off terminal end 48 of furniture leg 50.

Although the best mode contemplated by the inventors of carrying out the present invention is disclosed above, practice of the above invention is not limited thereto. It will be manifest that various additions, modifications and rearrangements of the features of the present invention may be made without deviating from the spirit and the scope of the underlying inventive concept.

I claim:

1. A furniture glide mountable on a terminal end of a furniture leg having an outer surface, comprising:

a rigid base having an upper surface extending along a first plane, a lower surface and an outer periphery;

a rigid sidewall arcing upwardly and outwardly from the outer periphery of the base and then inwardly to form an upper lip, the sidewall including a lower portion adjacent the outer periphery of the base and intersected by the first plane, an upper portion and an intermediate portion therebetween intersected by a second plane spaced from and generally parallel to the first plane and having:

a generally concave inner surface continuously circumferentially surrounding a cavity for receiving the furniture leg, the inner surface terminating at a lower edge which intersects the upper surface of the base and at an upper edge which intersects the upper lip; and a generally convex outer surface; and a matted material molded into the lower surface of the base and the outer surface of the sidewall;

wherein the intermediate portion of the sidewall has a thickness less than a thickness of the upper portion of the sidewall and less than a thickness of the lower portion.

2. The furniture glide of claim 1 wherein the sidewall is fabricated from a rigid plastic material.

3. The furniture glide of claim 1 wherein the matted material is fabricated from a felt fabric.

4. The furniture glide of claim 1 further comprising a base indentation area approximately centered with respect to the base, wherein the base indentation area is substantially thinner than another area of the base.

5. The furniture glide of claim 1 wherein the upper lip of the sidewall includes at least one notch formed therein.

6. The furniture glide of claim 1 wherein the upper lip of the sidewall includes a plurality of circumferentially spaced notches formed therein.

7. A furniture glide mountable on a terminal end of a furniture leg having an outer surface, comprising:

a base having an upper surface extending along a first plane, a lower surface and an outer periphery;

a sidewall extending upwardly from the outer periphery of the base, the sidewall having:

a generally concave inner surface continuously circumferentially surrounding a cavity for receiving the terminal end of the furniture leg, the inner surface terminating at a lower edge which intersects the upper surface of the base and an upper edge which defines an opening communicating with the cavity;

a generally convex outer surface;

a lower portion adjacent the outer periphery of the base and being intersected by the first plane;

an upper portion; and an intermediate portion between the upper and lower portions of the sidewall, the intermediate portion being intersected by a second plane generally parallel to and spaced from the first plane; and a matted material molded into the lower surface of the base and the outer surface of the sidewall;

wherein the intermediate portion of the sidewall has a thickness less than a thickness of the upper portion of the sidewall and less than a thickness of the lower portion.

8. The furniture glide of claim 7 wherein the sidewall is fabricated from a rigid plastic material.

9. The furniture glide of claim 7 wherein the matted material is fabricated from a felt fabric.

10. The furniture glide of claim 7 further comprising a base indentation area approximately centered with respect to the base, wherein the base indentation area is substantially thinner than another area of the base.

11. The furniture glide of claim 7 wherein the matted material includes an outer surface, the outer surface of the matted material including an indentation centered with respect to the base in which the matted material is molded.

12. The furniture glide of claim 11 wherein the upper surface of the base includes an indentation, the indentation in the upper surface of the base being axially aligned with the indentation in the outer surface of the matted material.

13. The furniture glide of claim 7 wherein the upper portion of the sidewall includes at least one notch formed therein.

14. The furniture glide of claim 7 wherein the upper portion of the sidewall includes a plurality of circumferentially spaced notches formed therein.

15. A furniture glide mountable on a terminal end of a furniture leg having an outer surface, comprising:

a base having an upper surface extending along a first plane, a lower surface and an outer periphery, the upper surface including an indentation centrally disposed therein;

a sidewall extending upwardly from the outer periphery of the base, the sidewall having:

a generally concave inner surface continuously circumferentially surrounding a cavity for receiving the terminal end of the furniture leg, the inner surface terminating at a lower edge which intersects the upper surface of the base and an upper edge which defines an opening communicating with the cavity;

a generally convex outer surface;

a lower portion adjacent the outer periphery of the base and being intersected by the first plane;

an upper portion; and an intermediate portion between the upper and lower portions of the sidewall, the intermediate portion of the sidewall having a thickness less than a thickness of the upper portion of the sidewall and less than a thickness of the lower portion, the intermediate portion being intersected by a second plane generally parallel to and spaced from the first plane; and a matted material having an inner surface molded into the lower surface of the base and the outer surface of the sidewall, and an outer surface, the outer surface of the matted material including an indentation axially aligned with the indentation in the upper surface of the base.

16. The furniture glide of claim 15 wherein the upper portion of the sidewall includes at least one notch formed therein.

17. The furniture glide of claim 15 wherein the upper portion of the sidewall includes a plurality of circumferentially spaced notches formed therein.

18. The furniture glide of claim 15 wherein the sidewall is fabricated from a rigid plastic material.

19. The furniture glide of claim 15 wherein the matted material is fabricated from a felt fabric.

* * * * *